US008234820B2

(12) United States Patent
Forbis et al.

(10) Patent No.: US 8,234,820 B2
(45) Date of Patent: Aug. 7, 2012

(54) SPECIAL BRACKET AND METHOD FOR INSTALLING A MODULAR FIREPLACE MANTEL

(75) Inventors: John Forbis, San Juan Capistrano, CA (US); John Edgley, Mt. Eliza (AU)

(73) Assignee: California Mantel, Inc., Sacramento, CA (US)

( * ) Notice: Subject to any disclaimer, the term of this patent is extended or adjusted under 35 U.S.C. 154(b) by 55 days.

(21) Appl. No.: 12/710,306

(22) Filed: Feb. 22, 2010

(65) Prior Publication Data

US 2010/0212254 A1 Aug. 26, 2010

Related U.S. Application Data

(60) Provisional application No. 61/154,688, filed on Feb. 23, 2009.

(51) Int. Cl.
*F24B 1/198* (2006.01)

(52) U.S. Cl. ..... 52/36.3

(58) Field of Classification Search ..... 52/36.3; 248/205.1, 241, 243, 244, 250; 403/326, 403/329; 211/90.01; 312/245; 108/42, 108, 108/152

See application file for complete search history.

(56) References Cited

U.S. PATENT DOCUMENTS

| | | | | |
|---|---|---|---|---|
| 2,457,373 | A * | 12/1948 | Hunter | 248/244 |
| 3,550,894 | A * | 12/1970 | Kaplan | 248/316.4 |
| 3,749,349 | A * | 7/1973 | Kaplan | 248/488 |
| 5,878,987 | A * | 3/1999 | Hayde | 248/477 |
| 6,796,088 | B2 | 9/2004 | Richmond et al. | |
| 7,007,363 | B2 * | 3/2006 | Forbis | 29/428 |
| 7,424,789 | B2 | 9/2008 | Zhou | |
| 2003/0084617 | A1 * | 5/2003 | Smith | 52/3 |
| 2006/0021287 | A1 * | 2/2006 | Warren | 52/36.3 |
| 2006/0226316 | A1 * | 10/2006 | Sellers | 248/244 |

* cited by examiner

*Primary Examiner* — Branon Painter
*Assistant Examiner* — Keith Minter
(74) *Attorney, Agent, or Firm* — Lewis Brisbois; Bisgaard & Smith LLP

(57) ABSTRACT

A method for installing a modular fireplace mantel surrounding a fireplace in a wall utilizing a unique leaf spring bracket. The leaf spring bracket for a modular fireplace mantel comprises a base plate, an upper lip, a lower lip, a left side lip and a right side lip attached to said base, said four lips defining a recess, a slot cut in the meeting edges of the base plate and the upper and lower lips, an extension attached to each of said left side and right side lips, each extension having one or more holes through which connectors may pass, an arcuate shaped leaf spring adapted to fit into said recess, both ends of said leaf spring having a reverse arc adapted to fit into said slots.

3 Claims, 7 Drawing Sheets

SPECIAL BRACKET AND METHOD FOR INSTALLING A MODULAR FIREPLACE MANTEL

This application claims the benefit of U.S. Provisional Patent Application Ser. No. 61/154,688, filed Feb. 23, 2009, which application is incorporated herein by reference in its entirety.

FIELD OF THE INVENTION

The present invention relates to fireplace mantles and more particularly to an improved bracket and method for installing modular mantels at the opening of a fireplace.

BACKGROUND OF THE INVENTION

Fireplace mantles located in front of in-wall fireplaces come in all shapes and sizes and are quite decorative. Mantels are either custom made or they are massed produced and come in component pieces that are assembled and put in place in front of the in-wall fireplace. Mantels may be made of stone, wood or simulated materials. With respect to modular mantels it has been known to use brackets or an adhesive to assemble and install the components of the mantel on the wall. The components generally comprise a hearth extension, a face plate, support legs, an under mantel, and a top mantel.

Difficulties in assembling and installing the mantel include leveling the mantel and having the entire mantel structure held flush to the wall. This is often done with an adhesive, and because of the heavy weight of the mantel members and the time of the drying of the adhesive, the installation has been a difficult and demanding job.

A conventional bracket for installation of a modular fireplace is shown in U.S. Pat. No. 6,796,088, particularly FIGS. 9-10A which show a flat bracket through which screws and bolts are driven. The mantel is attached to the wall by the use of an elongated cleat 168 which is secured to the wall by screws or bolts. In addition, fasteners are used to anchor components 170, 172 to the floor of the room in order to secure the mantel to the floor.

U.S. Pat. No. 7,424,789 shows another bracket system for installing a modular fireplace mantel. The bracket described in this patent is C-shaped with number of planer extensions which are set at predetermined angles to one another. The systems shown in both of the patents discussed above are quite complex and difficult for a non-professional to accomplish.

SUMMARY OF THE INVENTION

Installation of a modular fireplace mantel of this invention comprises a step-by-step method easily accomplished by a non-professional. Part of the easy of assembly is a unique leaf spring bracket of this invention, best shown in FIGS. 9 and 10. The bracket comprises a generally rectangular base with raised sides and two extending lips and a leaf spring which fits into the recess in the rectangular base. The mantle top is placed so that embedded L-brackets fit into the unique leaf spring brackets which have been affixed to the wall, making placement of the mantel top flush with the wall easily accomplished, because the leaf spring pulls the entire mantel flush to the wall.

DETAILED DESCRIPTION OF THE INVENTION

Figure 1:
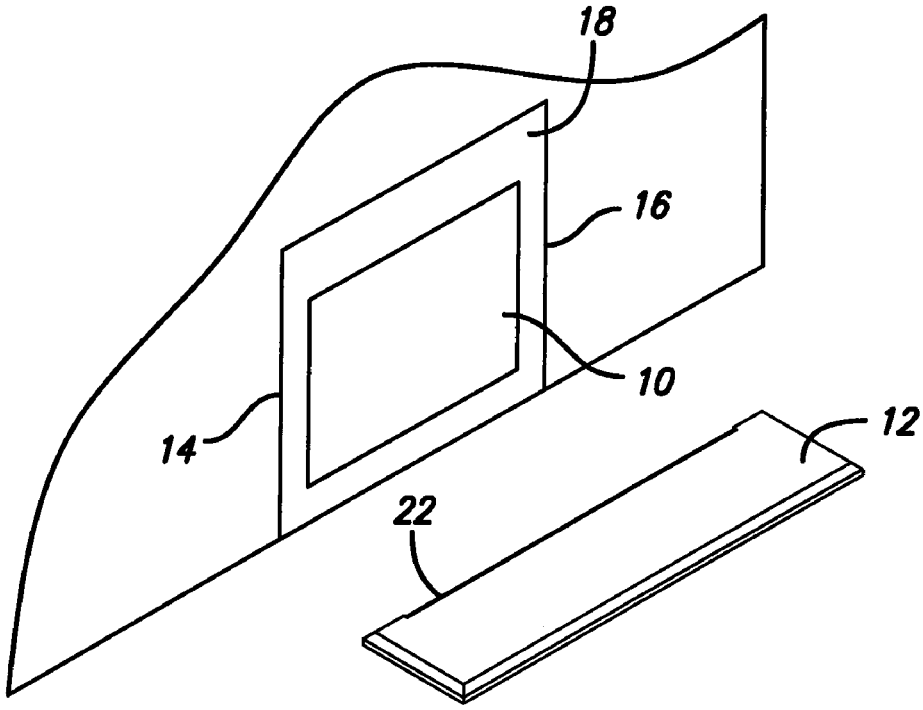
FIG. 1 is a depiction of the first step in installation of the modular fireplace mantel.

Referring now to the drawings, there is shown a fireplace modular mantel which is installed using the unique leaf spring bracket of this invention.

Proper framing used to install the fireplace itself is critical to the installation of the mantle. Drywall needs to be flush with the face of the fireplace. All pre-drilled holes and embedded hardware provided with the mantel utilize fireplace framing members for strength. When assembling the mantel, screws should not be tightened completely until instructed. There should be some play in the pieces to allow for proper alignment and the best possible fit. Panels must be held in proper alignment to each other while tightening the screws, to assure fewer gaps and proper surface alignment.

Step 1. Remove any protrusions in the floor and walls around the fireplace to ensure a level surface. Mantel components need to fit flush against the wall. Ensure that the walls and hearth area are clean of any debris or dust.

Step 2. Place the hearth extension 12 in front of fireplace 10 (see FIG. 1). Check to ensure that hearth extension 12 is flat, level and plumb with fireplace 10. Shim or float under hearth extension 12 if necessary to level. Lift hearth extension 12 up 90° and rest against fireplace 10. Apply construction adhesive to the bottom of hearth extension 12, leaving room at the edges so as not to leak when applied to the floor. Lift hearth extension 12 up so that it is parallel with the floor. Align 2 black marks at the rear of hearth extension 12 with the outer edges 14 and 16 of the fireplace face plate 18 and apply to the floor. Cover hearth extension 12 with a piece of cardboard to protect it during the remaining installation.

Figure 2:
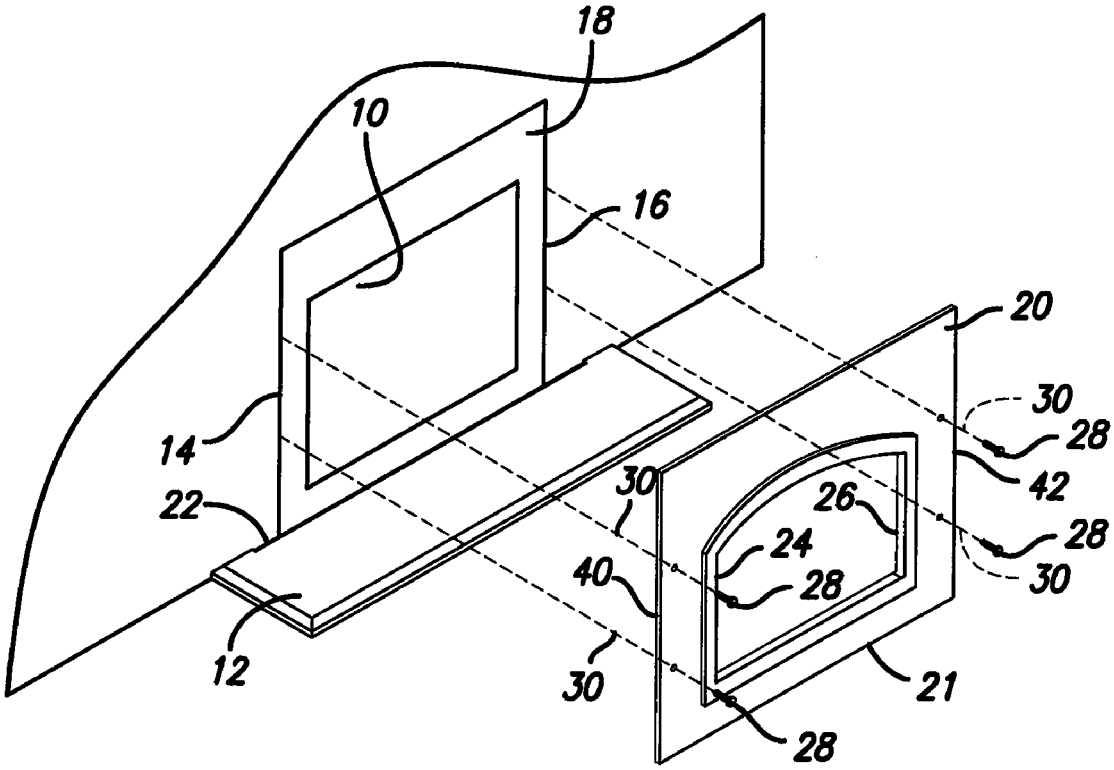
FIG. 2 is a depiction of the second step in installation of the modular fireplace mantel.

Step 3. Apply construction adhesive to rear of face plate 20. Pick up face plate 20 so that it is parallel to the fireplace face plate 18. Rest the bottom edge 21 of face plate 20 in a groove 22 at the rear of hearth extension 12 (see FIG. 2). Align the inside edges 24 and 26 of face plate 20 with the fireplace opening. Tilt face plate 20 towards the fireplace 10. Hold face plate 20 in place until all screws 28 have been secured. Using 4 holes 30 on face plate 20 as a guide, drill pilot holes using a ⅛" drill bit into the wall studs (fireplace framing). If desired, use metal anchors for added support if the holes 30 miss the framing and penetrate drywall only. Secure face plate 20 using 4 screws 28.

Figure 3:
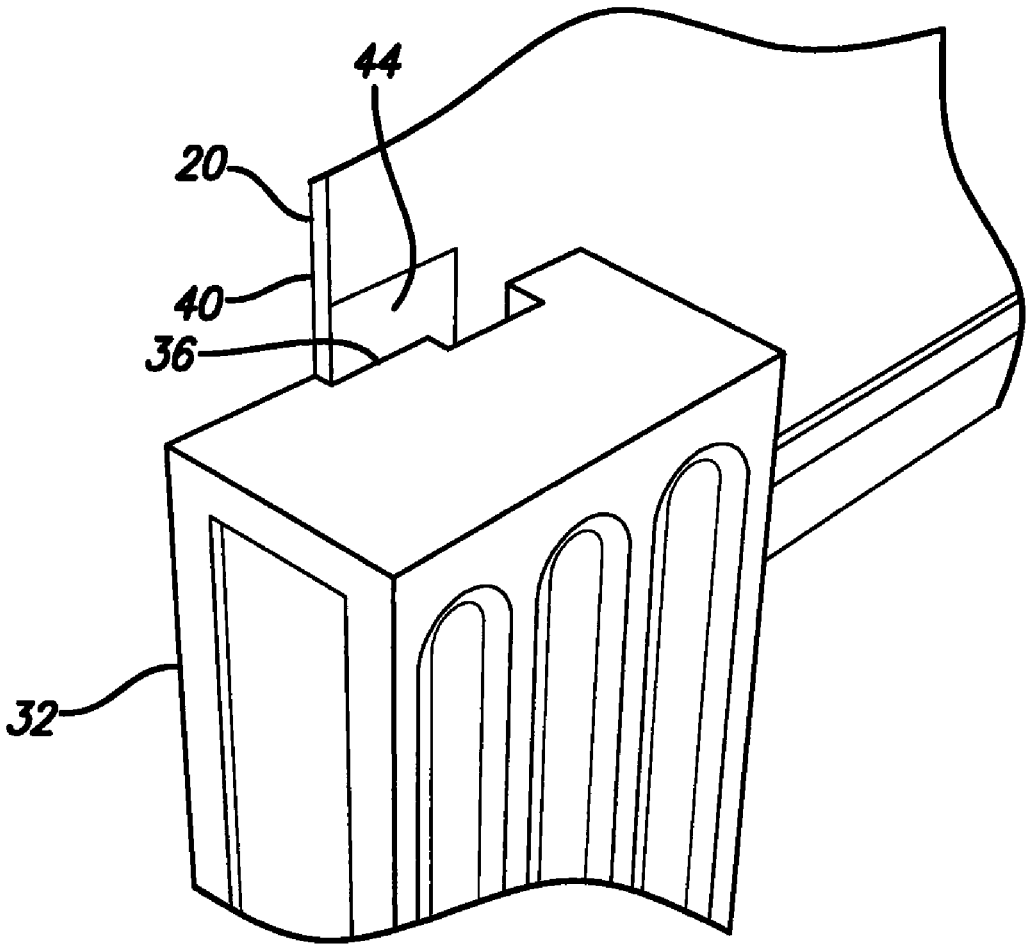
FIG. 3 is a depiction of the third step in installation of the modular fireplace mantel.
Figure 4:
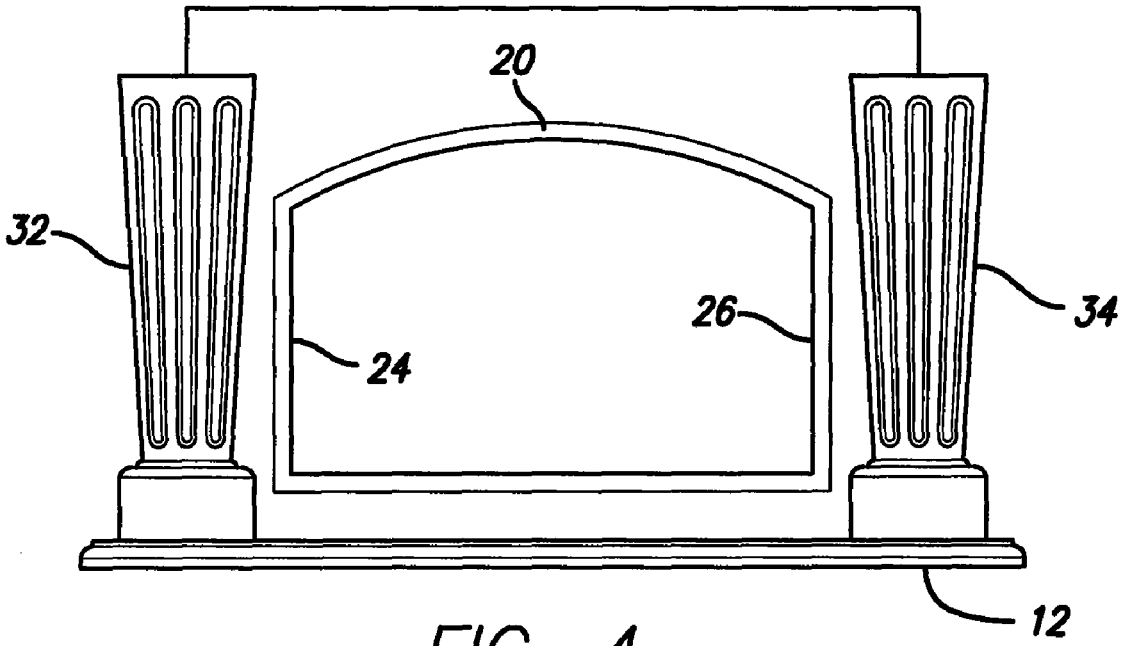
FIG. 4 is a depiction of the fourth step in installation of the modular fireplace mantel.
Figure 5:
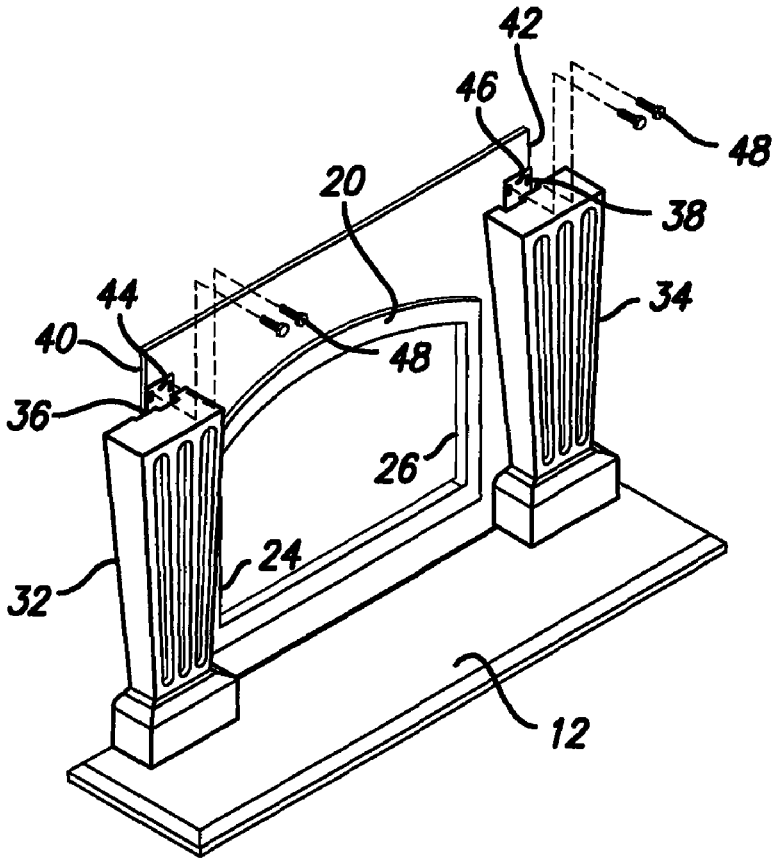
FIG. 5 is a depiction of the fifth step in installation of the modular fireplace mantel.

Step 4. Place left 32 and right 34 legs on protective material on hearth extension 12 for a test fit. A notch 36 and 38 on the rear of each leg 32 and 34 will match outer edges 40 and 42 of face plate 20 (see FIGS. 3 and 4). Verify that legs 32 and 34 are level and plumb to hearth extension 12 and fireplace 10. Remove the protective material from underneath legs 32 and 34, being careful not to change the plumb and level of the setup. Using slots in brackets 44 and 46 as a guide, drill pilot holes, using a ⅛" drill bit, in the wall studs (fireplace framing). Tilt legs 32 and 34 towards the room and place construction adhesive on the rear edges of legs 32 and 34. Carefully place legs 32 and 34 snugly against the wall and face plate 20. Secure legs 32 and 34 to the wall using 4 screws 48, through brackets 44 and 46 at the top of each leg (see FIG. 5).

Figure 6:
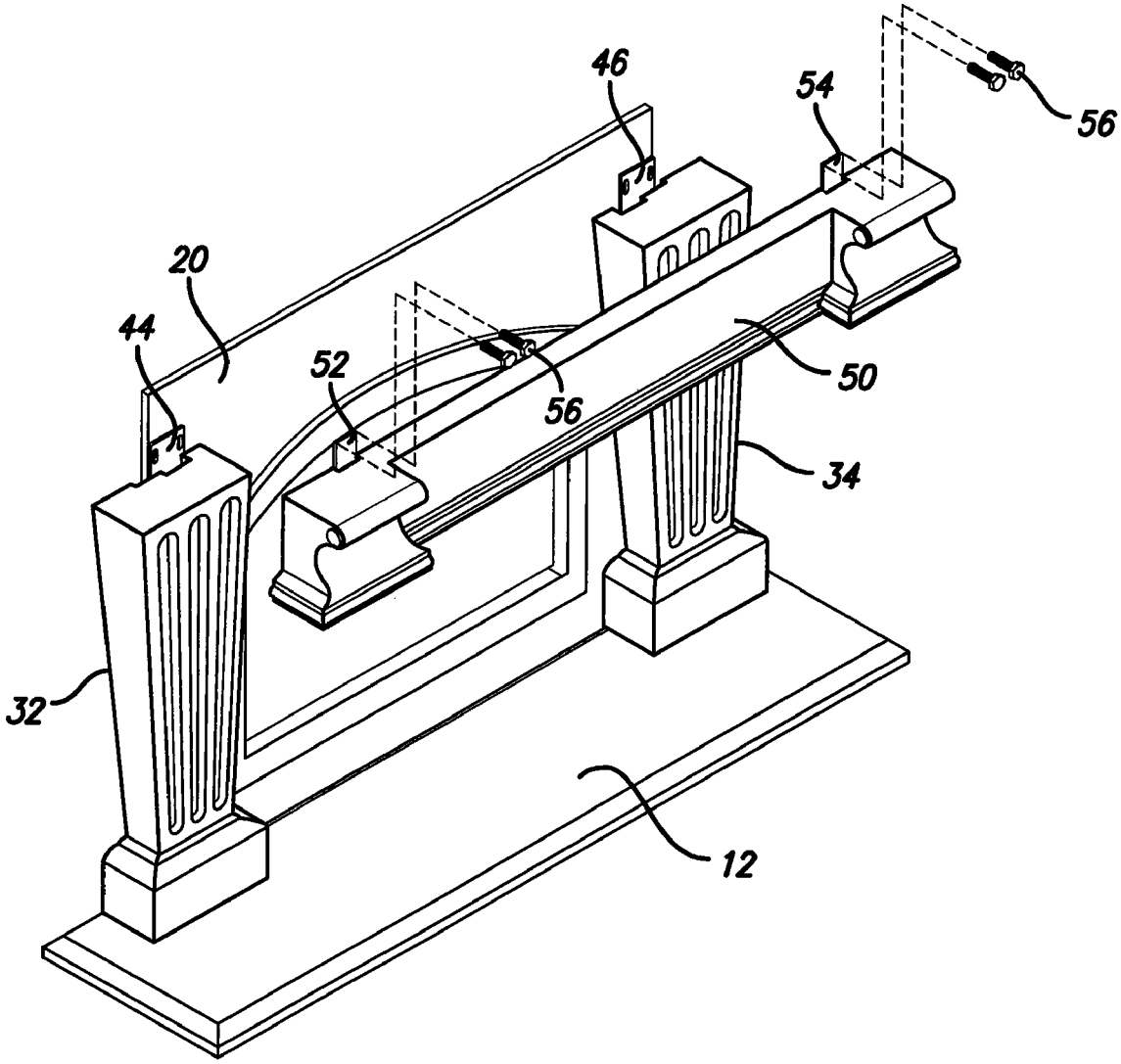
FIG. 6 is a depiction of the sixth step in installation of the modular fireplace mantel.

Step 5. Carefully, lift under mantel 50 up and center it on the top of legs 32 and 34. Verify that under mantel 50 is level to the floor. Using slots in brackets 52 and 54 as a guide, drill pilot holes using ⅛" drill bit in the wall studs (fireplace framing). Secure to the wall using 2 screws 56 through each of brackets 52 and 54 which have been secured to under mantel 50 (see FIG. 6).

Figure 7:
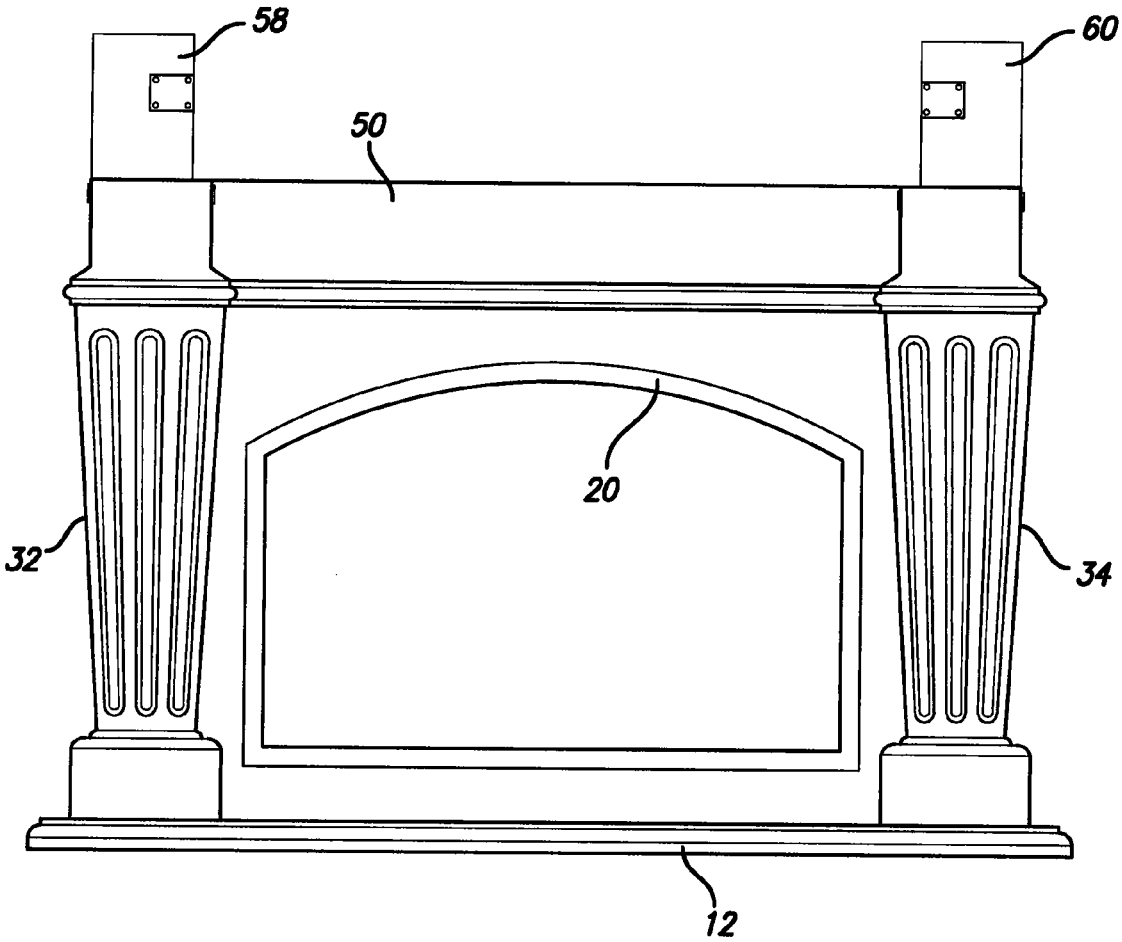
FIG. 7 is a depiction of the seventh step in installation of the modular fireplace mantel.

Step 6. Attach templates 58 and 60 to the wall over under mantel 50 (see FIG. 7). Verify that a metal spring 62 is inserted in the back of both leaf spring brackets 64 and 66 (see FIG. 9). Place brackets 64 and 66 on templates 58 and 60 in their predetermined location. Secure brackets 64 and 66 to wall studs 74 using 4 screws 68 in holes 69. Verify that brackets 64 and 66 are level to the floor.

Step 7. Carefully lift mantel top 70 up and over under mantel 50. Insert embedded brackets 72 and 73 located in back of mantel 70 into previously installed leaf spring brackets 64 and 66 (see FIG. 8) centering mantel top 70 over under mantel 50. Verify that mantel 70 is centered. Leaf spring brackets 64 and 66 have a ½ inch play. Leaf spring brackets 64 and 66 are not intended to be load bearing. Their purpose is to pull mantel top 70 flush with the wall, leaving no gaps. The weight of mantle top 70 rests on mantel legs 32 and 34. Tighten all screws.

Step 8. Using caulk or grout, fill the corners and edges between the mantel components 115 and between the mantel top 70 and the dry wall, if desired.

Figure 9:
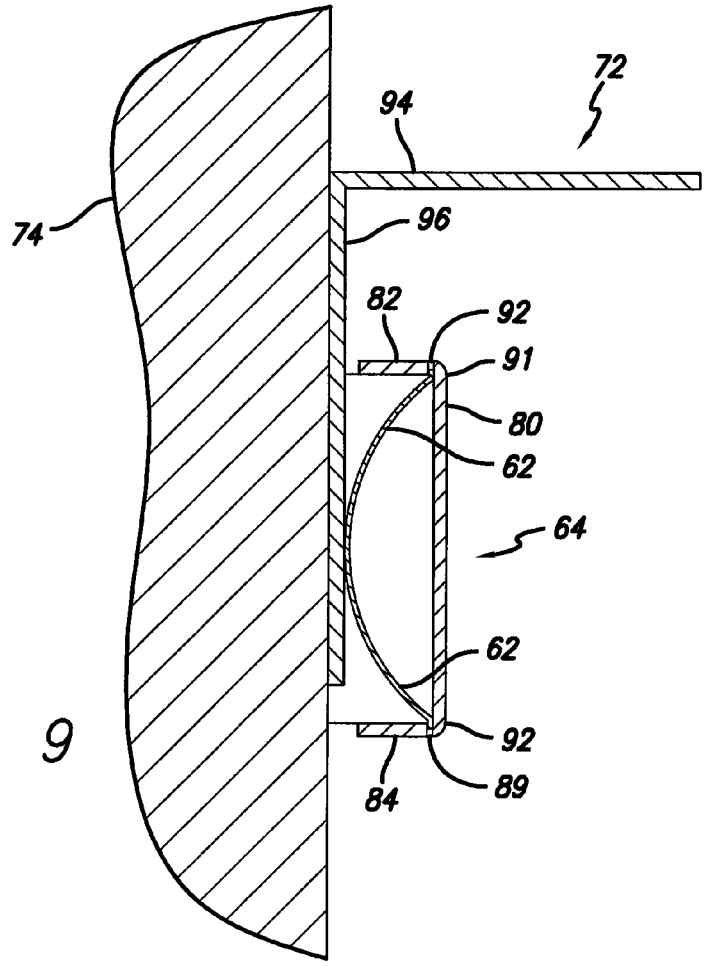
FIG. 9 is a cross-section view of the leaf spring bracket.
Figure 10:
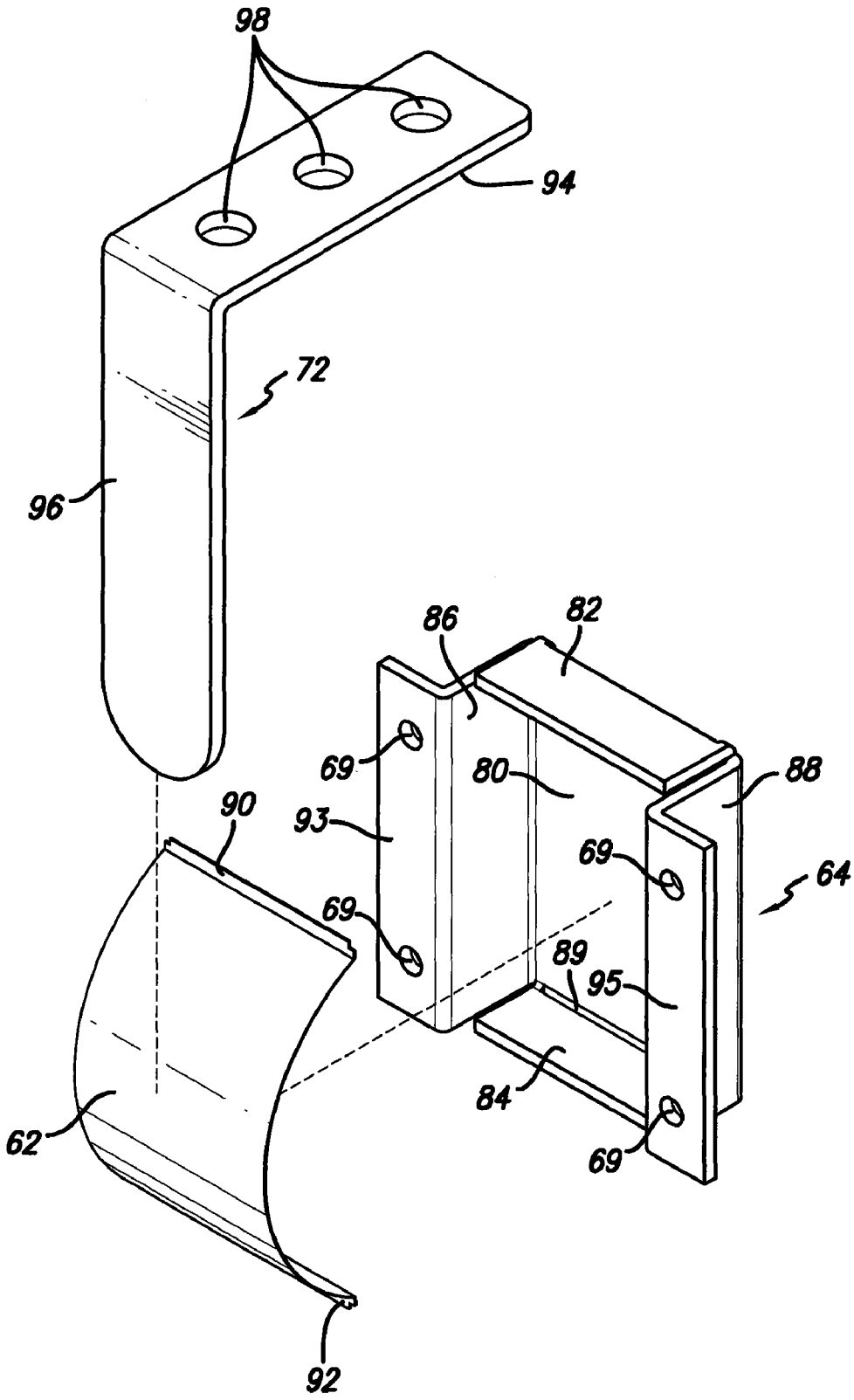
FIG. 10 is a perspective view of the leaf spring bracket.

Referring to FIGS. 9 and 10, there is shown in detail the unique leaf spring brackets 64 and 66. Bracket 64 comprises a base plate 80 having an upper lip 82 and a lower lip 84 which extend horizontally from base plate 80. A left side lip 86 and a right side lip 88 extend vertically 120 from base plate 80. Upper lip 82, lower lip 84, left side lip 86 and right side lip 88, form a recess in bracket 64. Where upper and lower lips 82 and 84 meet base plate 80, there are slots 89 and 91 adapted to receive the ends 90 and 92 of leaf spring 62, as described below. Upper and lower lips 82 and 84 are narrower in width than left and right side lips 86 and 88 to provide room to insert L-shaped brackets 72 and 73.

Vertical extensions 93 and 95 extend 90 degrees from left and right side lips 86 and 88. Extensions 93 and 95 have holes 69 through which are passed connecting screws (not shown) to connect brackets 64 and 66 to the wall 74.

Leaf spring 62 is arcuate (C-shaped) and has reverse curved end pieces 90 and 92 adapted to fit into slots 89 and 91, to hold leaf spring 62 in place in the recess of bracket 80.

Figure 8:
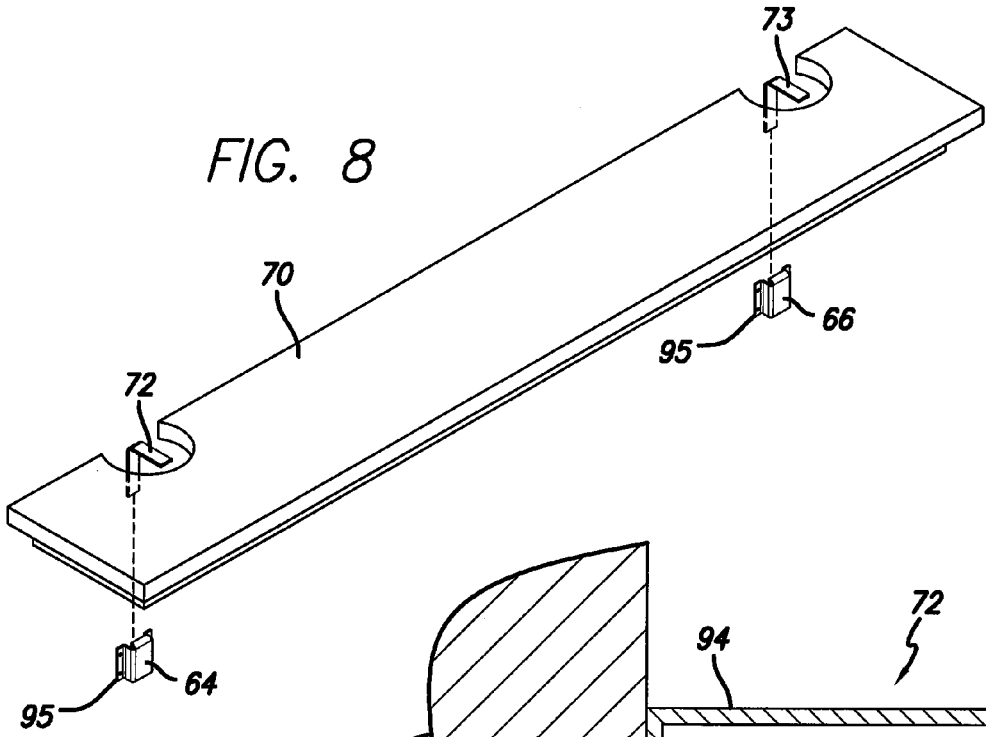
FIG. 8 is a perspective view of the mantle top of the modular fireplace mantel.

L-bracket 72 has a horizontal leg 94 and a vertical leg 96. Horizontal leg 94 has a plurality of holes 98 to fasten L-bracket 72 to the bottom of mantel 70. Then, as shown in FIGS. 8 and 9, mantel 70 is placed over under mantel 50 by inserting L-brackets 72 and 73 into previously installed leaf spring brackets 64 and 66. The vertical legs 96 of L-brackets 72 and 74 slide behind the arcuate leaf springs 62 in brackets 64 and 66, which bend inward, pulling mantel 70 flush with wall 74, leaving no gaps. Leaf springs 62 bend inward toward the recess in bracket 64. The pressure of the outward tension of leaf springs 62, pushing in an outward direction, holds mantel 70 against wall 74.

Having thus described the invention, we claim:

1. A leaf spring bracket for a modular fireplace mantel comprising a base plate, an upper lip, a lower lip, a left side lip and a right side lip attached to said base plate, said four lips defining a recess, slots cut in the meeting edges of the base plate and the upper and lower lips, extensions attached at a 90° angle outwardly to each of said left side and right side lips, each extension having one or more holes through which connectors may pass to fasten the bracket to a wall, an arcuate C-shaped leaf spring adapted to fit into said recess, both ends of said leaf spring having a reverse curved end piece adapted to fit into said slots to hold said leaf spring in place in the recess of said base plate.

2. A combination bracket system for a modular fireplace mantel comprising the leaf spring bracket of claim 1 and an L-shaped bracket, having a horizontal leg and a vertical leg, the horizontal leg having holes to receive attachment means to attach the L-shaped bracket to the mantel and the vertical leg adapted to frictionally fit behind the arcuate C-shaped leaf spring to hold the mantel against a wall.

3. The combination bracket system of claim 2 in which the upper and lower lips are narrower in width than the left and right lips in order to receive the vertical leg of the L-shaped bracket.

* * * * *